US007841052B2

(12) United States Patent
Ducauchuis

(10) Patent No.: US 7,841,052 B2
(45) Date of Patent: Nov. 30, 2010

(54) MOULDED SELF-GRIPPING HOOK-IN-HOOK FASTENING

(75) Inventor: Jean-Pierre Ducauchuis, Nantes (FR)

(73) Assignee: APLIX, Paris (FR)

( * ) Notice: Subject to any disclaimer, the term of this patent is extended or adjusted under 35 U.S.C. 154(b) by 1037 days.

(21) Appl. No.: 11/490,217

(22) Filed: Jul. 20, 2006

(65) Prior Publication Data

US 2007/0022580 A1 Feb. 1, 2007

(30) Foreign Application Priority Data

Jul. 29, 2005 (FR) ..... 05 08144

(51) Int. Cl.
*A44B 18/00* (2006.01)

(52) U.S. Cl. ..... 24/452

(58) Field of Classification Search ..... 24/442, 24/446, 449, 450, 452
See application file for complete search history.

(56) References Cited

U.S. PATENT DOCUMENTS 5,067,210 A * 11/1991 Keyaki ..... 24/452
5,457,856 A * 10/1995 Murasaki ..... 24/452
5,615,461 A * 4/1997 Tominaga et al. ..... 24/452
D425,405 S * 5/2000 Naohara et al. ..... D8/382
RE36,779 E 7/2000 Takizawa et al. ..... 24/452
7,162,780 B2 * 1/2007 Martin et al. ..... 24/452

FOREIGN PATENT DOCUMENTS

| | | |
|---|---|---|
| EP | 0 464 754 | 7/1991 |
| EP | 0 574 863 | 6/1993 |
| WO | WO 0015069 A1 * | 3/2000 |
| WO | WO 01/58302 | 8/2001 |

* cited by examiner

*Primary Examiner*—Robert J Sandy
(74) *Attorney, Agent, or Firm*—Renner, Kenner, Greive, Bobak, Taylor & Weber

(57) ABSTRACT

Object, particularly molded, having at least one surface from which at least one field of hooks projects, particularly through molding, each hook being constituted by a stem section and a head section projecting laterally from the stem section, the hooks being arranged in rows, characterized in that in at least one row the hooks are arranged according to a cycle constituted by m successive right/left hooks, of which the heads project from the stems in a first direction, and n successive hooks in a second left/right direction, following the m hooks, of which the heads project in a second left/right direction opposing the first direction, whereby m and n are integers such that 1 £ m<n.

17 Claims, 10 Drawing Sheets

Preferably:
Distance E always > residual clearance J
Width L2 always > width L1
P always > 0

Example:
E = 0.04
J = 0.03
L1 = 0.49
L2 = 0.58
P = 0.02

MOULDED SELF-GRIPPING HOOK-IN-HOOK FASTENING

TECHNICAL FIELD

The present invention relates to an object, particularly moulded, having at least one surface, from which hooks have been moulded to form part of a self-gripping fastening, and to an assembly of at least two objects, particularly moulded, of this type, wherein the hooks of one of the at least two objects snap into the hooks of another of the at least two objects.

A moulded object is already known from the prior art and in particular the U.S. Pat. No. 5,368,549, with a field of hooks projecting from one face thereof which are moulded in a one-piece construction with the moulded object during its production.

This moulded object of the prior art has the drawback that the hooks which are realised through moulding, particularly through ejection of the hook head from a moulding cavity, are realised with a form and according to a layout such that it is not possible to obtain a hook-in-hook fastening, but only a hook-in-loop fastening with another object or another part of the object. In fact, these hooks have heads which are relatively supple in order to allow their removal from the mould and a hook-in-hook snap-in connection does not "hold", in particular does not resist torsional stresses, by reason of this relative suppleness.

DISCLOSURE OF THE INVENTION

It is an object of the present invention to overcome the drawbacks of the prior art by making available for the first time an object, particularly moulded, with any form, having a first face with a directly moulded field of hooks which can cooperate with another field of hooks of the same type coming from a second object, or another part of the object, for a fixing or fastening of the hook-in-hook type. The fact that this object can be realised through moulding facilitates large-scale production in a simple way.

According to the invention the object, particularly moulded, having at least one surface, from which at least one field of hooks projects directly through moulding, each hook being constituted by a stem section and a head section projecting laterally from the stem section, the hooks being arranged in rows, is characterised in that in at least one row the hooks comprise at least a succession of successive m single head hooks of right/left direction, of which the heads project from the stems in a first direction, and n successive hooks of left/right direction, following the m hooks, of which the heads project at least in a second left/right direction opposing the first direction, whereby m and n are integers such that 1 £ m<n. Preferably, all the hooks have a single head.

By thus providing an alternation of hooks in one direction, then in the other, also with dissymmetry (m and n being different from each other), it is thus possible to snap the hooks of an object with the hooks of another object and thus obtain a so-called hook-in-hook fastening which works well, although the hooks only have a single head (that is to say a single head projecting from a single side of the stem, and in particular it is not a mushroom head or a double head) and have a shape and dimensions and are made from a material which allows them to be removed from cavities in the form of hooks by deforming slightly at the time of extraction, then resuming their form corresponding to that of the mould. Until now, with single head hooks, and particularly with hooks coming directly from moulding, it has not been possible to obtain a hook-in-hook fastening, particularly by reason of too great a suppleness of the hooks. The dissymmetry appears to ensure that some of the hooks of said at least one row snap into the opposing hooks of the fastening whereas other hooks abut the stem of the opposing hooks in order to block the two rows of the two objects which snap into each other, in order to thus prevent relative sliding of the two rows and ensure a hook-in-in hook fastening which holds well.

According to a development of the invention, in said at least one row there is also provided a succession of m' hooks with a single head in left/right direction and n' hooks at least in right/left direction, whereby m' and n' are integers such that 1 £ m'<n'.

By having two inverse successions in the same row, a male self-gripping body is thus obtained, the fastening of which works better due to being self-centred.

According to a development of the invention the hooks are arranged in rows and columns and in at least one column every m+n columns all the hooks are oriented in the same direction and in particular when m=1 and n=2 in one column every three columns all the hooks are orientated in the same direction.

According to a development of the invention, the hooks are arranged in rows and columns in such a way that in a first column all the hooks are orientated in the first same direction, then in a first even number of following columns the hooks in each row are arranged in pairs, the hooks of each pair being orientated back to back in the odd/even rows and face to face in the even/odd rows, then in the following column all the hooks are orientated in the second same direction, then again in a second even number of following columns the hooks in each row are arranged in pairs, the hooks of each pair being orientated back to back in the odd/even rows, and face to face in the even/odd rows, then again in the following column all the hooks are orientated in the first direction and so on.

In particular it is preferable for the first direction and the second direction to be opposing directions in order to thus obtain a self-centring during the snapping of a male part into another.

According to a development of the invention the hooks in at least one row are arranged according to a repetition cycle constituted by m right/left single head hooks and n left/right hooks.

According to a development of the invention the rows are offset with respect to each other by of a number of hooks between 1 and m−n−1.

The rows are repeated as a maximum every m−n rows and in particular when m=1 and n=2 the rows are repeated every two rows, two contiguous rows being offset with respect to the other of a hook.

According to a development of the invention the hooks are arranged in rows and columns and in at least one column every m+n columns all the hooks are orientated in the same direction and particularly when m=1 and n=2, in one column every three columns all the hooks are orientated in the same direction.

According to a development of the invention the inter-stem distance (distance between the hook stems at the level of said at least one surface) between the two successions of n and m hooks (between the $n^{th}$ hook of the n hooks and the first of the m hooks) is smaller than any of the inter-stem distances between two other hooks of the row, and in particular this distance is approximately zero.

According to a development of the invention the inter-stem distance between the two successions of m and n hooks (between the $n^{th}$ hook of the m hooks and the first of the n hooks) is greater than any of the inter-stem distances between two other hooks of the row.

According to a preferred embodiment the distance between two rows is strictly smaller than the transverse thickness of the hooks, measured in the direction of the columns, particularly perpendicularly to the rows, and is preferably smaller than half of the transverse thickness.

The present invention also relates to an assembly constituted by a first object, particularly moulded, according to the invention and a second object, particularly moulded, according to the invention, the fields of hooks of the first object engaging the hooks of the field of hooks of the second object in order to fix the first object to the second object.

BRIEF DESCRIPTION OF THE DRAWINGS

An embodiment of a moulded object and an assembly according to the invention will now be described by way of example. Reference will hereby be made to the drawings, in which.

PREFERRED EMBODIMENT FOR CARRYING OUT THE INVENTION

Figure 1:
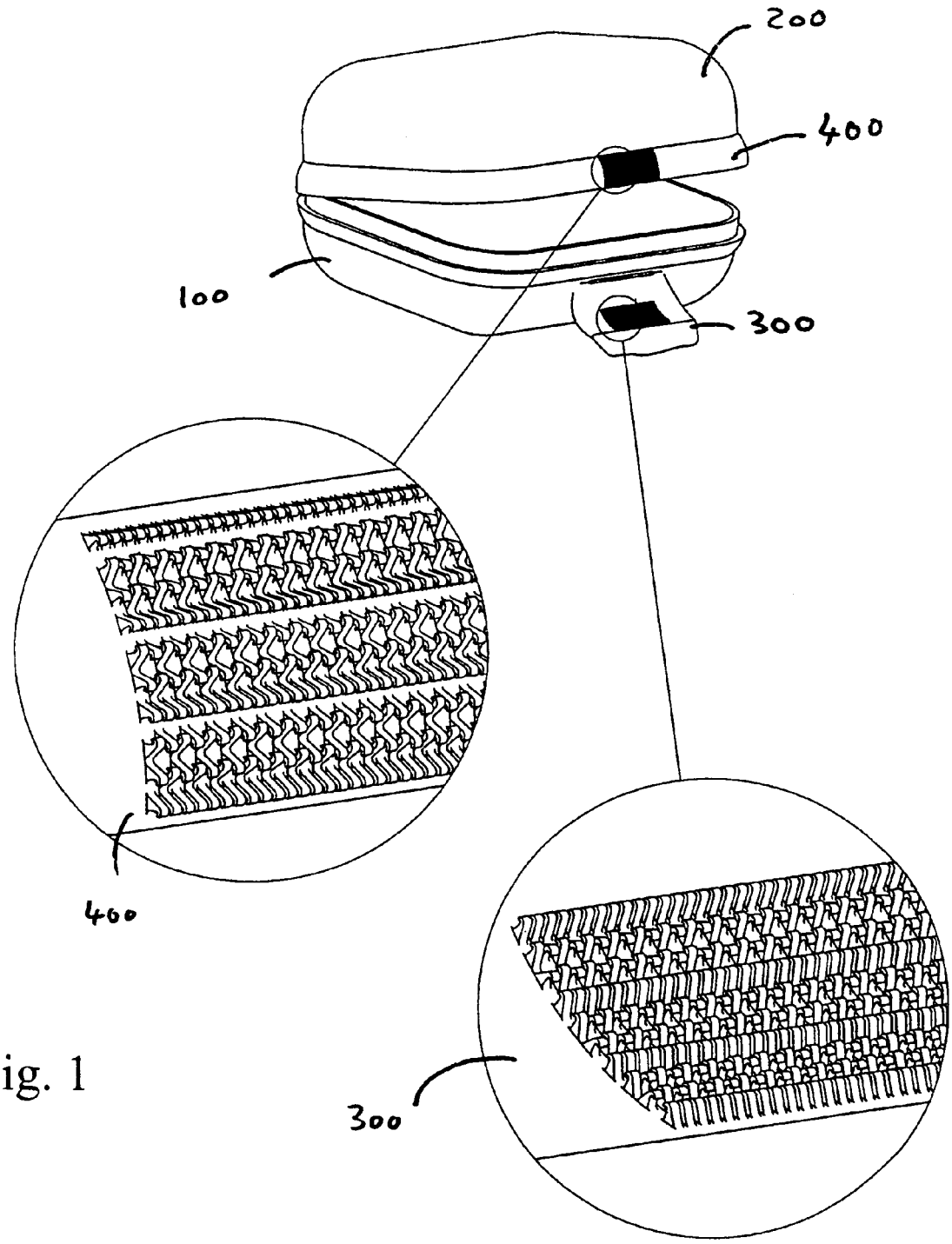
FIG. 1 shows a box made of thermoplastic material formed by moulding, from one surface of which hooks project according to the invention.

As can be seen in FIGS. 1 to 4, hooks project from a surface 2 of a base plate 20. The hooks are arranged in rows (direction CD), parallel to each other, and columns (MD direction), parallel to each other. In a given row 4, hooks 6, 7 and 8 follow each other in succession. The hook 6 is orientated to the right, that is to say its hook head projects laterally from its stem in the direction towards the right of the stem in the drawings, in the direction of the row 4. The hook 7 immediately following has a head which projects in a direction towards the left, in the direction of the row, in the same way as the hook 8 immediately following in the row. The cycle then starts again with a right hook equivalent to the hook 6, then two left hooks equivalent to hooks 7, 8 and so on. In this case, one has m=1 and n=2.

In the immediately following row 5 the hooks are arranged according to the same repetition cycle. However, the hooks 6', 7', 8' of the second row 5 are offset with respect to those 6, 7, 8 of the first row 4 by one hook towards the left, that is to say in the same direction as the orientation of the n hooks (7 and 8 in the case here where n=2). The hook 7 and the hook 8' and the equivalent hooks (same reference in the drawings) to these two hooks in the following rows are aligned in a column 10, in which all the hooks 7, 8', etc., of the column are orientated in the same direction.

Figure 9:
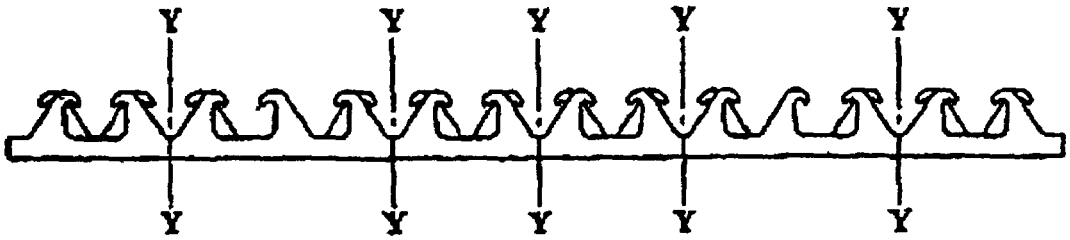
FIG. 9 is a side view of the plate of FIG. 7.
Figure 10:
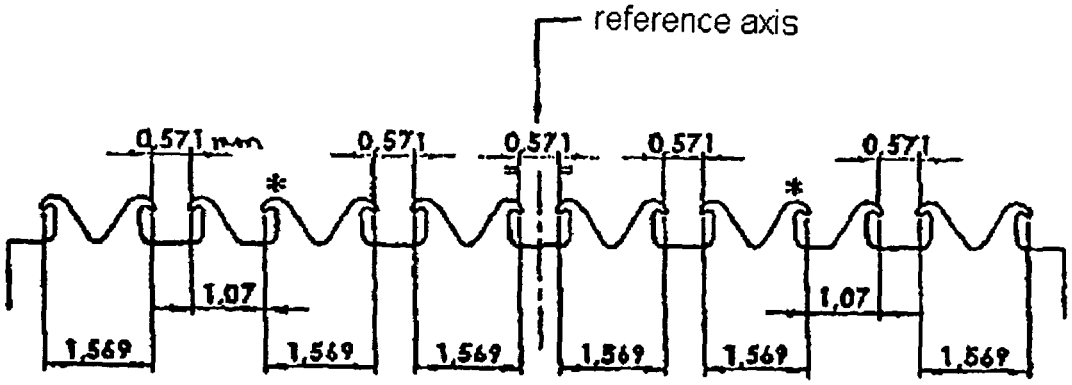
FIG. 10 shows a side view of the second row from the front of the plate of FIG. 9.

Between two successive columns in which all the hooks 7, 8' are orientated in an identical way, in the odd rows, for example the first row 4, the two successive columns are separated by one or several pair(s) of hooks (1 pair in FIG. 2, 3 pairs in FIG. 9), being so-called face to face hooks (that is to say of which the heads are orientated towards each other), whereas in the odd rows (for example row 5) the two successive columns are separated by one or several couple(s) (1 couple in FIG. 2, 3 couples in FIG. 9), being so-called back to back hooks, that is to say of which the hook heads are orientated in opposite directions.

In the embodiment of FIGS. 1 to 4, one column in three is a column like the column 10. In another possible embodiment which is not shown one column 10 in two (or three or four, or also in a random way) could be replaced by a column of the same type but having its hooks orientated in the other direction.

Between two successive columns 10, in one row 4 in two, there are two hooks 8 and 6 which are orientated in opposition and have an inter-stem distance measured on the surface 2 along the row 4 which is approximately equal to zero.

Between two successive columns 10, in the other row 5 in two, there are two hooks 6', 7' with facing orientation.

The distance (measured on the surface 2 by the distance between the stems along the row) between two hooks 7 and 8 orientated in the same direction and following each other in a row is approximately equal to half of the distance between two hooks 6 and 7 of which the heads face each other.

The distance A between two successive hooks 7, 8' in a column is smaller than the dimension B of the heads of the hooks measured in the direction of the column, preferably smaller than B/2.

Figure 4A:
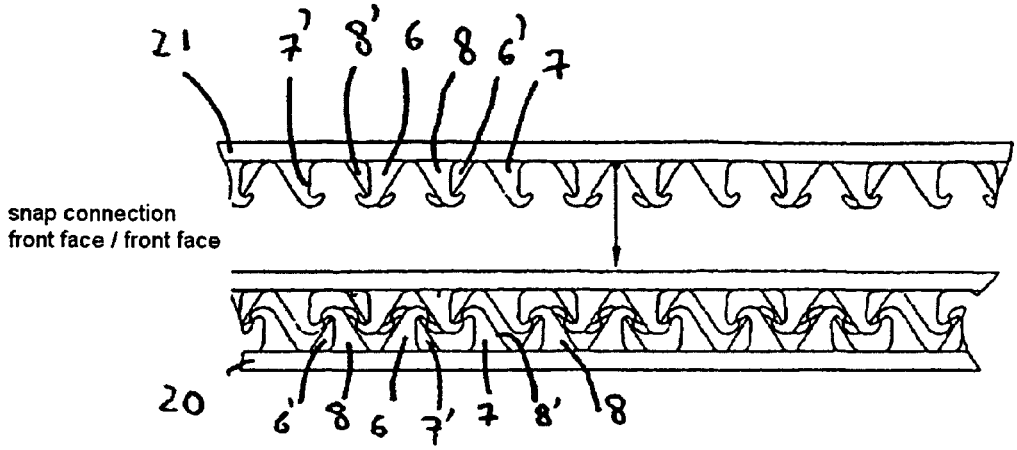
FIGS. 4*a* and 4*b* are side views of an assembly of two sections, each having a hook surface as described in FIGS. 2 or 3, following snapping of front face/front face (FIG. 4*a*) or front face/rear face (FIG. 4*b*).
Figure 4B:
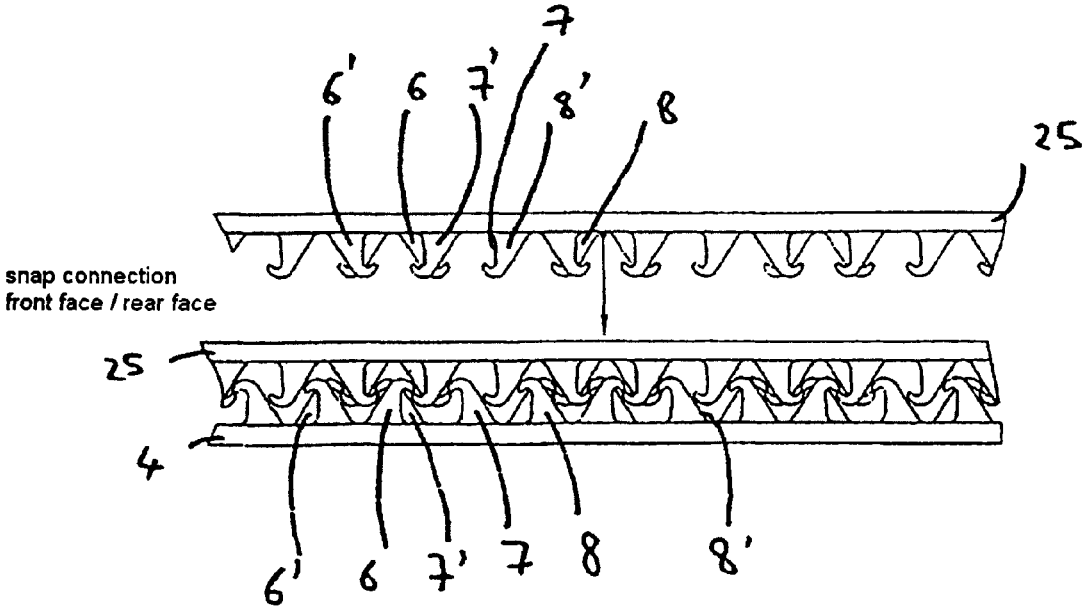
Figure 5:
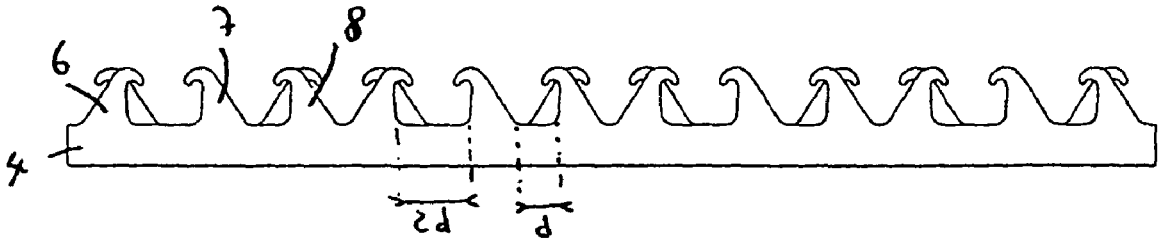
FIG. 5 is a side view of a section of the plate of FIG. 2.

In FIGS. 4*a* and 4*b* one can see how the hooks of a plate engage or snap into the hooks of another plate in order to realise the self-gripping hook-in-hook fastening.

In FIG. 4*a* the upper plate 21 is identical to the lower plate 20, being simply rotated by 180°. On the first row 4*a* a hook 8 of a first row of the lower plate 20 snaps with its head into the head of a hook 7 of the upper plate 21, a hook 7 of the first row 4 of the lower plate 20 snaps with its head into the head of a hook 8 of the first row of the upper plate, and a hook 6 of the first row 4 of the lower plate abuts with its head the stem of a hook 8 of the upper plate. In the same way, a hook 6 of the row 4 of the upper plate abuts with its head the stem of a hook 8 of the lower plate. On the second row 5 a hook 8' of the row of the lower plate 20 abuts with its head the stem of a hook 6' of the upper plate 21, a hook 7' of the row 5 of the lower plate 20 snaps with its head into the head of a hook 8' of the row 5 of the upper plate, and a hook 6' of the row 5 of the lower plate abuts with its head the stem of a hook 8' of the upper plate. In the same way a hook 6' of the row 5 of the upper plate abuts with its head the stem of a hook 7' of the row 5 of the lower plate, a hook 7' of the row 5 of the upper plate abuts with its head the stem of a hook 6' of the lower plate, and a hook 8' of the row 5 of the upper plate snaps with its head into a hook 7' of the row 5 of the lower plate.

Figure 2:
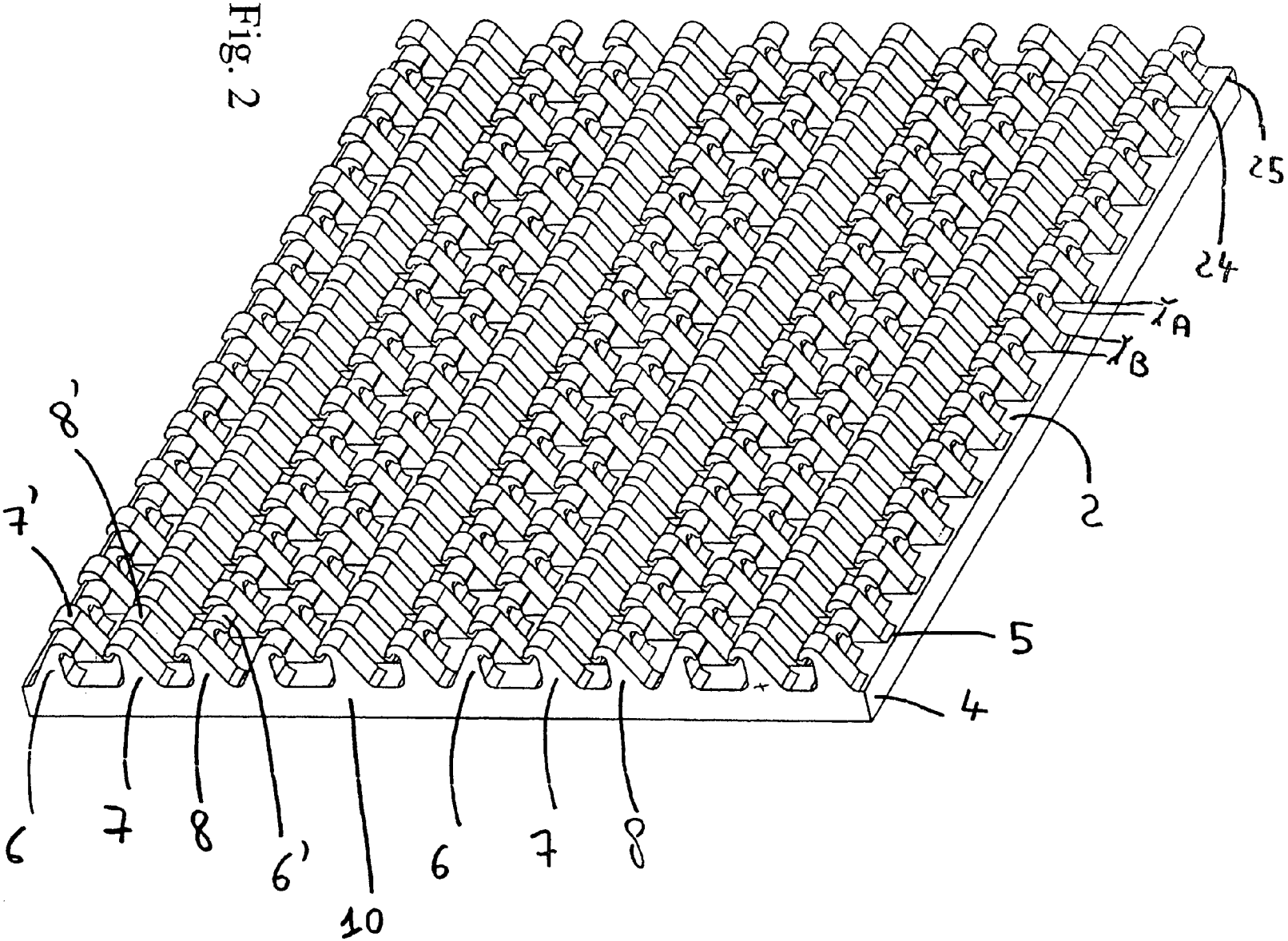
FIG. 2 shows, in a perspective view, an intermediate fixing plate, to the back of which an anchoring element can be fixed, for example a pin in the shape of a fir needle, and comprising on its other face a field of hooks according to the invention.
Figure 3:
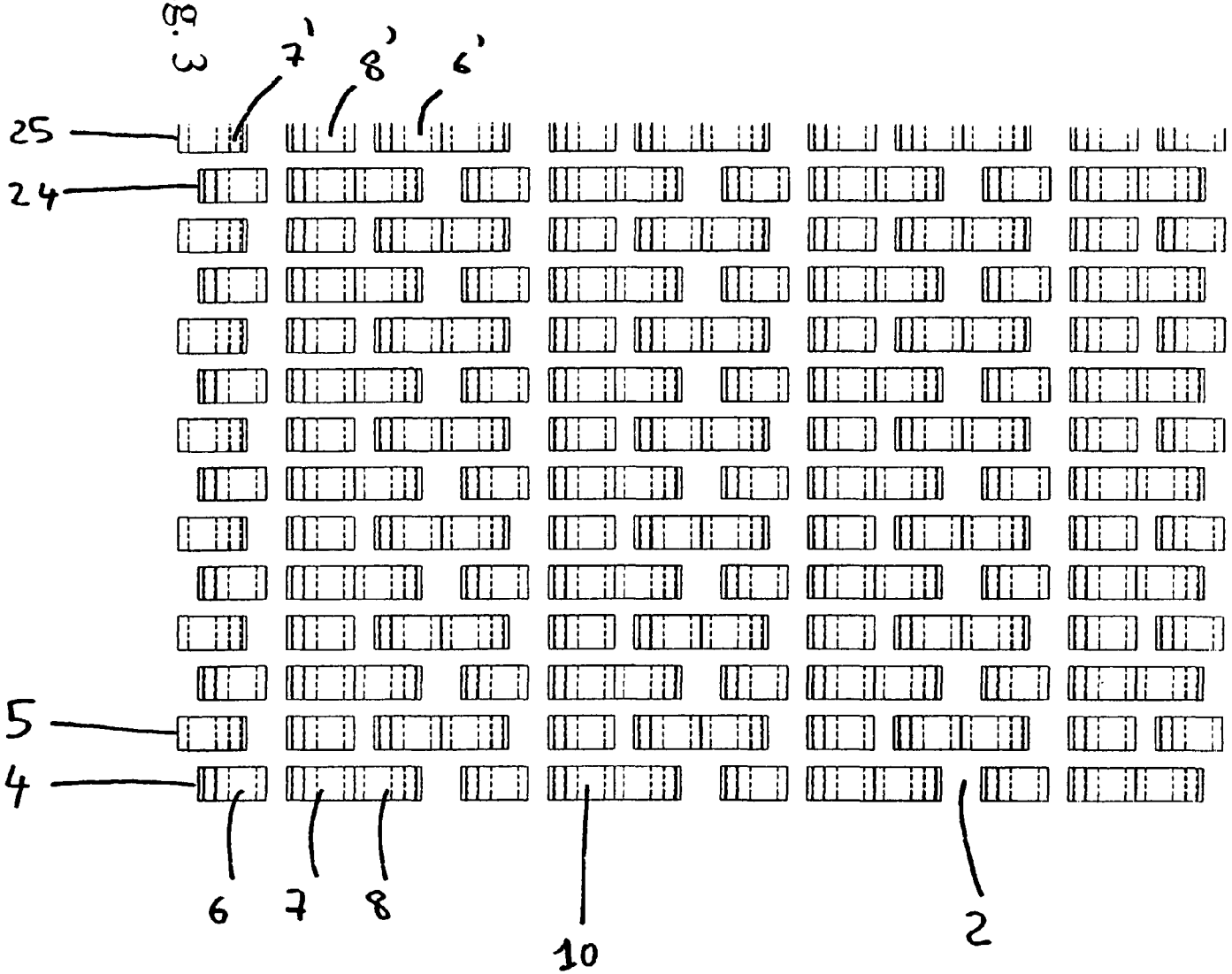
FIG. 3 is a top view of the plate of FIG. 2.

In the case of FIG. 4*b* there is an upper plate which is also rotated by 180° with respect to the lower plate but which has also been rotated on itself in such a way that the front row (the row 4 in FIG. 2) is now on the other side of the plate, having been replaced by the back row (row 25 in FIG. 2).

In this configuration the hooks 6 of the row 4 of the lower plate snap with their heads into hooks 7' of the row 25 of the upper plate. The hooks 7 of the row 4 of the lower plate abut with their heads the stem of a hook 7' of the row 25 of the upper plate. The hooks 8 of the row 4 of the lower plate abut with their heads the stem of a hook 8' of the row 25 of the upper plate. The hooks 6' of the row 25 of the upper plate abut with their heads the stem of a hook 6 of the row 4 of the lower plate. The hooks 8' of the row 25 of the upper plate abut the stem of a hook 7 of the row 4 of the lower plate and the hooks 7' of the row 25 of the upper plate snap into the hooks 6 of the row 4 of the lower plate. In the same way the hooks 6' of a row 5 of the lower plate snap with their heads into hooks 8 of the row 24 of the upper plate. The hooks 7' of the row 5 of the lower plate abut with their heads the stem of a hook 8 of the row 24 of the upper plate. The hooks 8' of the row 5 of the lower plate snap with their heads into the head of a hook 6 of the row 24 of the upper plate. The hooks 6 of the row 24 of the upper plate snap with their heads into the head of a hook 8' of the row 5 of the lower plate. The hooks 7 of the row 24 of the upper plate abut the stem of a hook 8' of the row 5 of the lower plate. The hooks 8 of the row 24 of the upper plate are fastened with their heads into the head of a hook 6' of the row 5 of the lower plate.

The rows are repeated according to a cycle of two. In FIG. 2 the row 4 (front face row) is the innermost row. The row 5 is the following row. It is offset by one row with respect to the row 4, the row which follows the row 5 is identical to the row 4, then the following row is identical to the row 5, and so on. The row 25 is the outermost row (rear face row). It is identical to the row 5, the row 24 is the row preceding the row 25. It is identical to the row 4.

Another embodiment is shown in FIGS. 7 to 10. As in the previously described embodiment there is provided in the row 4 (the first row) which is the most to the front in FIG. 7 a succession of m=1 right hook (hook 6) and n=2 left hooks (hooks 7 and 8). However, there is not provided a repetition of this succession following such a cycle. On the other hand, in this embodiment, there is also provided another succession of m'=1 left hook (hook 106) and of n'=2 right hooks (hooks 107 and 108).

In the odd rows (for example the first row) the repetition cycle of the hooks is thus constituted by 1 left hook 7, followed by three pairs of hooks back to back, then a right hook 107, then three pairs of hooks back to back, the cycle repeating then with a left hook.

In the even rows (for example the second row) the cycle is identical with the exception that the pairs of hooks are face to face pairs. According to another possible embodiment of the invention there could be provided a number of pairs of hooks which varies between two columns with constant hooks (it is a question of the columns where all the hooks are orientated in an identical way), whereby this variation could be in accordance with a law, for example increasing by 1 after each constant column, or random. In the same way one could have a variation of the orientation of the constant columns. It should be noted that in the case of the embodiment of FIGS. 7 to 10, the even rows are not even rows offset with respect to those of one or more hook(s).

Figure 11:
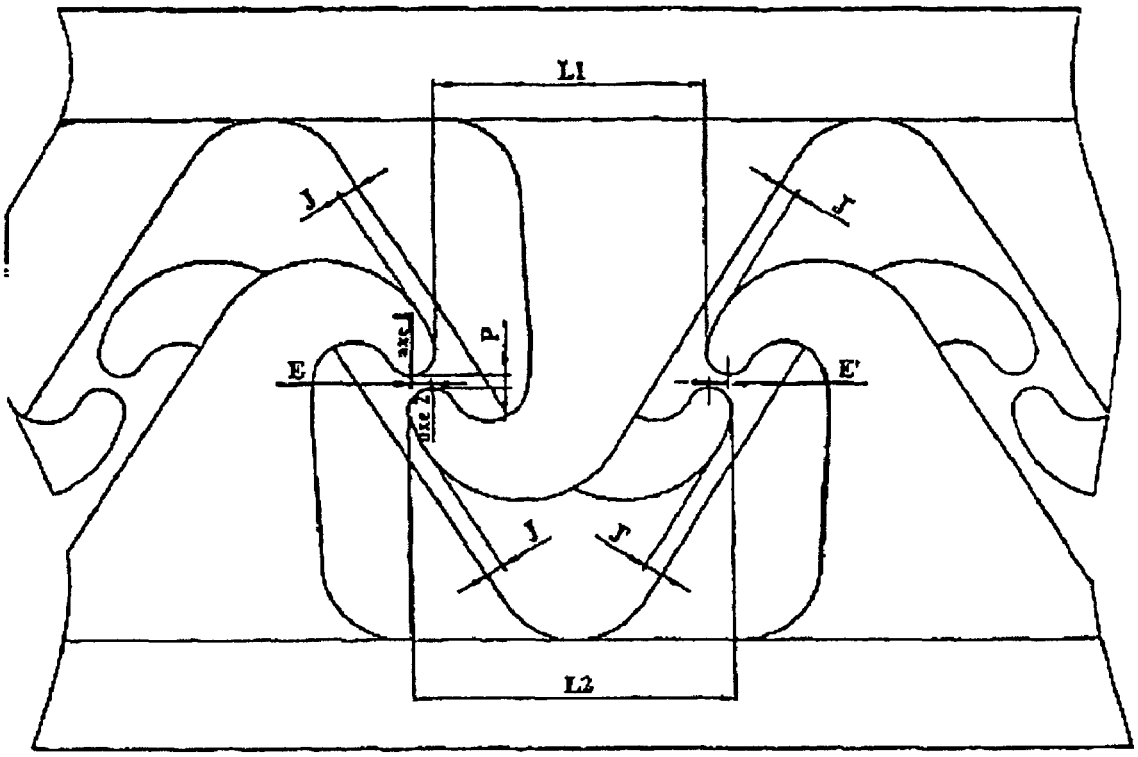
FIG. 11 shows a section of a fastening constituted by two plates according to the invention.
Figure 12A:
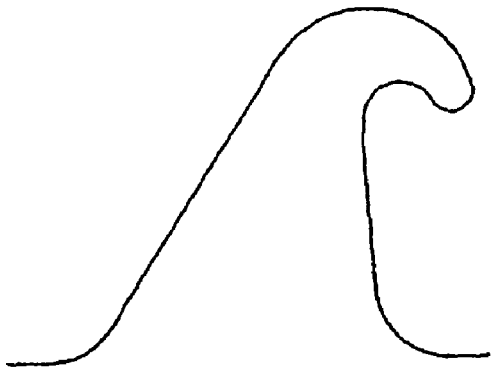
FIG. 12*a* shows a hook with a single head and a single club-shaped element.
Figure 12B:
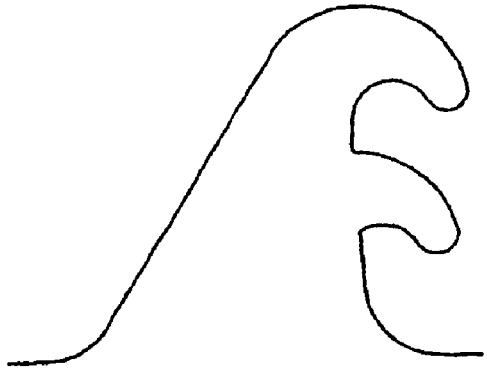
FIG. 12*b* shows a hook with a single head and a double club-shaped element.

In FIG. 11 one can see, on a greater scale, a section of the fastening comprising two plates. As can be seen, the clearance j is shown between a hook head and a hook stem in the case in which the hook head of one of the two plates abuts the stem of a hook of the other plate.

The different dimensions, configurations and forms of the fastening are chosen in such a way that the residual clearance J is smaller than the dimension E. This dimension E is the interval between the two fastening axes of two hooks which engage in each other, the fastening axis of a hook being the vertical line or perpendicular to the base of the plate and passing via the lowest point of the hook head.

Besides, the width L2 of a column of hooks measured at the level of the hook heads is always greater than the distance L1 between two hook heads of two successive columns. Finally, the spacing of the two plates is such that the distance between two hooks which engage in each other in the vertical direction P is always greater than zero.

Figure 6:
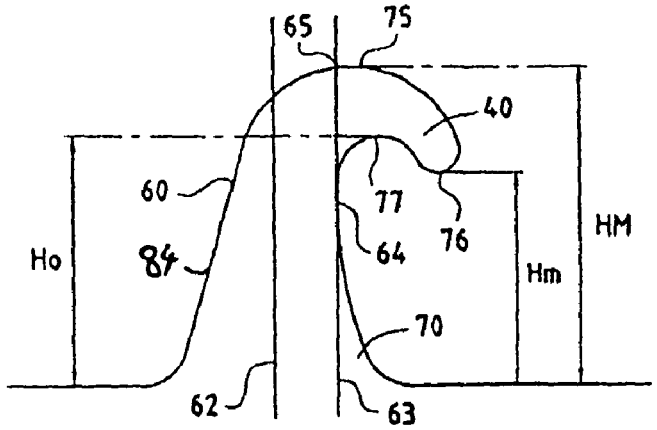
FIG. 6 is a face view of a hook of a field of hooks of an object according to the invention.
Figure 7:
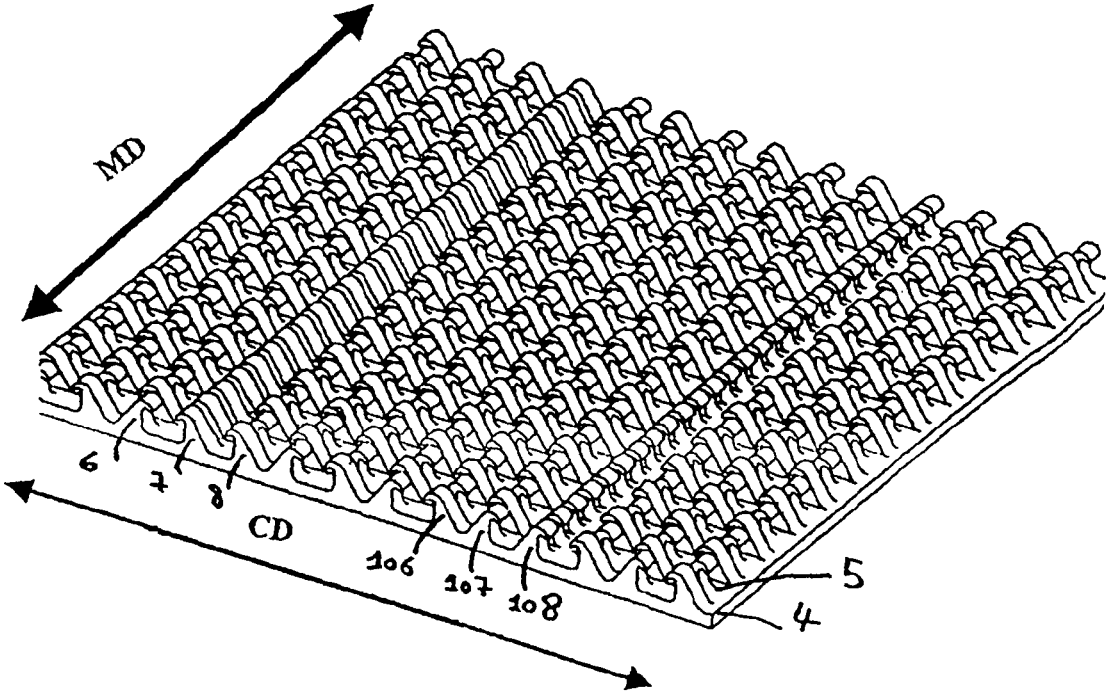
FIG. 7 is a perspective view of a hook plate having a hook arrangement according to another possible embodiment of the invention.
Figure 8:
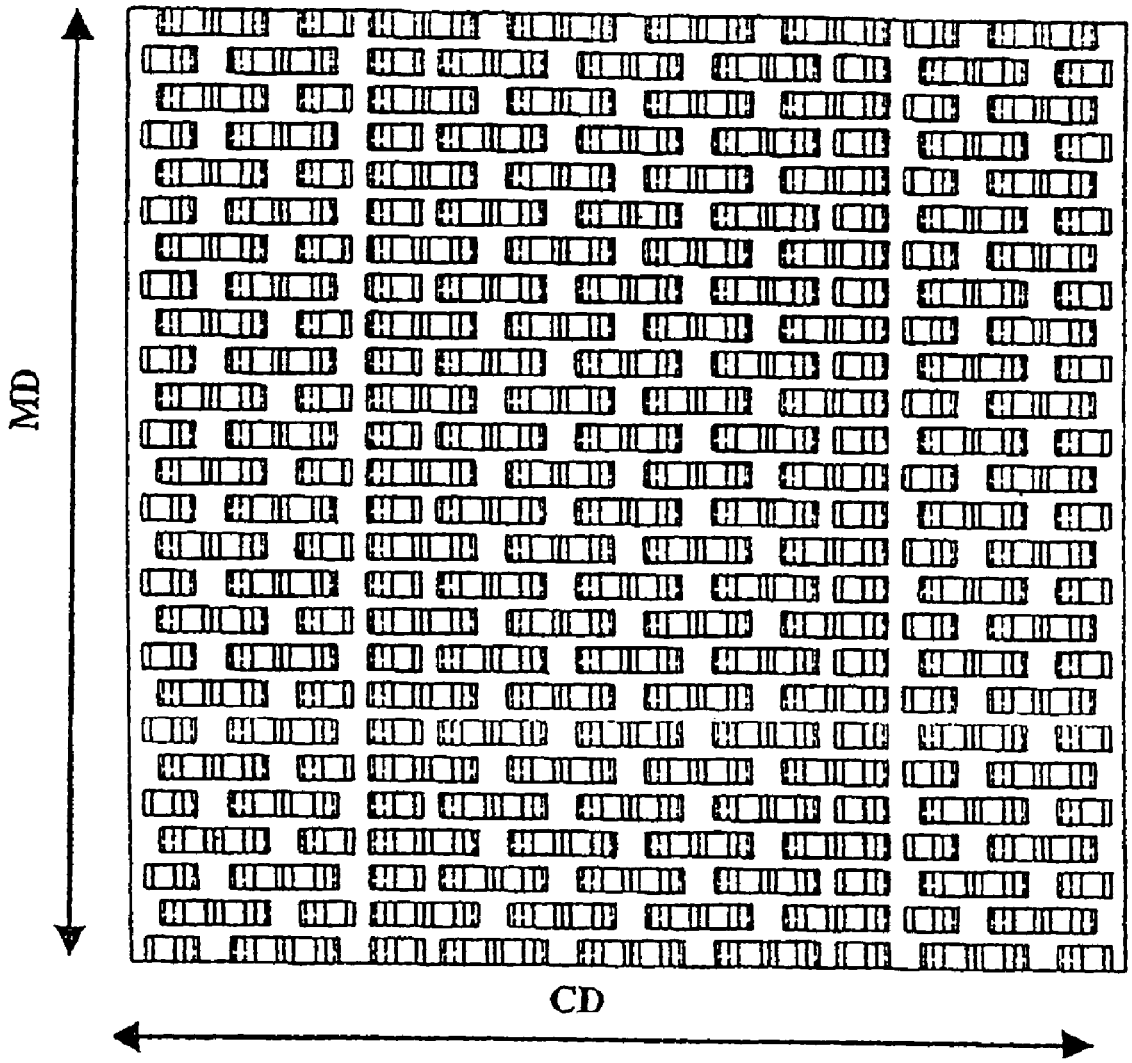
FIG. 8 is a top view of the plate of FIG. 7.

In FIG. 6 a hook according to the invention is shown in a longitudinal section. In the plan view of the drawing, there is thus defined an envelope curve 60 of the hook. For the hook 7 the (imaginary) axis 62 of the hook is defined as being the straight line perpendicular to the lower face 2 and passing via the middle of the base 61 of the hook.

The (imaginary) straight delimitation line of the hook head is defined as the first straight line 63 parallel to the axis 62 of the hook, starting from the axis 62 and offsetting to the right (left, respectively) which cuts the envelope curve 60 at two points (64 and 65). The section of the hook on the outside of the straight line 63 and above the point 64 is called the head 40 of the hook. The stem 50 of the hook is defined as the section of the hook which is located on the other side of the segment (64, 65) of the delimitation line 63.

Preferably, the stem 50 is widened (its width in the plan view of FIG. 6 decreases) from the bottom to the top of the hook.

From a top view, the hook has a rectangular shape, of which the length (horizontal width of the stem in the plan view of FIG. 6) and/or thickness (according to the perpendicular direction in relation to FIG. 6) decreases from the base to the head. However, one can also have a constant thickness. In the same way, the head of the hook has a rectangular shape as seen from above, with a constant thickness or a thickness decreasing in cross-section from the bottom to the top.

For the head 40, the greatest thickness in height is defined as being, measured along the axis 62 of the hook, the difference between the maximum height HM of the head (distance from the lower face 2 to the highest point 75, measured parallel to the axis 62) and the minimum height Hm of the head (the distance from the lower face 2 to the lowest point 76 of the head of the hook).

As for the fastening height Ho, this is equal to the distance along the axis 62, between the lower face 4 and the highest point 77 of the section of the envelope curve defining the lower surface of the head 40.

The profile of the head is thus defined as being the ratio (HM−Ho)/(HM−Hm). At the upper limit this profile is equal to 1, which corresponds to a horizontal hook head or to one which is orientated upwards (in these two cases, one has Hm=Ho).

In the case of hooks coming directly from moulding of a very rigid object, it is preferable for the profile of the head to be greater than 0.55, particularly greater than 0.60, preferably greater than 0.80 and more preferably greater than 0.9.

On the opposing side of the head, the section of the envelope curve defining the stem is constituted by the arc of a circle and a straight line 84 which is inclined with respect to the axis 62 approximately as far as cutting the delimitation line 63. The angle of inclination is preferably between 20° and 45°.

The section of the envelope defining the head is constituted by the upper arc of a circle (defining the upper surface of the head) and a lower arc of a circle (defining the lower surface of the head) and an intermediate arc of a circle. The radius of the upper arc of a circle is preferably between 0.10 and 0.5 mm, for example 0.32 mm, the radius of the lower arc of a circle is preferably between 0.04 and 0.25 mm, for example 0.12 mm and the arc of the intermediate circle is preferably between 0.01 and 0.10 mm, for example 0.06 mm.

Preferably, the section of the envelope curve defining the head does not include a point of inflection (its first derived function is continued at any point). The absence of a "pointed" section in the head of the hook assists in removal from the mould during its production.

The height HM is preferably between 0.25 and 2 mm, for example being equal to 1.43. The thickness of the plate 2 is preferably between 0.2 and 1.5 mm, for example 0.8 mm.

The height Hm is preferably between 0.1 and 1.05 mm, for example 0.91 mm.

The height Ho is preferably between 0.15 mm and 1.25 mm, for example 1.12 mm.

The width at the level of the plate 2 of the stem is preferably between 0.2 mm and 1.5 mm, for example 0.8 mm.

The width of the stem at the height of the intersection of the envelope curve with the delimitation line on the right (left, respectively) is preferably between 0.11 and 0.7 mm, for example 0.45 mm.

The thickness at height HM−Ho is preferably between 0.10 and 0.50 mm, more preferably between 0.20 and 0.40 mm, for example 0.32 mm.

The thickness at the height of the base is preferably between 0.1 mm and 4 mm, more preferably between 1 and 2 mm.

The ratio of the thickness at height HM−Ho over the thickness at the height of the base is less than 1, preferably less than 0.5, more preferably less than 0.3, particularly less than 0.2.

Appropriate thermoplastic materials—in particular the hooks come from moulding of a very rigid object—are polypropylenes or polyurethanes. For example, as polypropylene, one can choose a mixture of unsaturated polyester constituted by 50% homopolymer and 50% copolymer, having a fluidity index in molten state of 22 g/10 mn and a flexion module of 130,000 to 150,000 psi. Other possible materials comprise a polypropylene of Atofina, PPC 5660, having a fluidity index in molten state of 7 and a flexion module of 175,000 psi, copolymers of polypropylene of BP Amoco (Acclear 8949 and Acctuf impact copolymer 3934X) having fluidity index values in molten state of 35 to 100 and flexion modules of 190,000 to 250,000 psi; polystyrenes, acrylonitrile butadiene styrenes, high density polyethylene, low density linear polyethylene, polycarbonate. The indexes in molten state are between 1 and 100 and the flexion modules between 30,000 and 1,140,000, preferably between 100,000 and 1,000,000, more preferably between 300,000 and 1,000,000.

Resins other than resins with a polypropylene base which may be suitable are impact polystyrene, acrylonitrile butadiene styrene, nylon, high density polyethylene, low density linear polyethylene, polycarbonate and olefinic thermoplastic resins. Also possible are polypropylenes reinforced with long glass fibres having a very high flexion module (resin 30YM240/10010 having a flexion module of 856,000 psi and resin 40YM240/10010 having a flexion module of 1,140,000 psi, sold by StaMax). In this case the long glass fibres do not migrate into the cavities (which are too small or too thin for the long fibres to penetrate) and a rigid plate is thus obtained and, nonetheless, hooks which are sufficiently supple to eject themselves from the cavities.

The term "rigid" is used to describe an object which cannot be bent in a reversible manner beyond an angle of curvature of 5°.

The object can for example, as shown in FIG. 1, be a supple plastic box intended for example for preserving foodstuffs, having a lower section 100 and an upper section or lid 200. A tongue 300 projects from the lower section 100 and comprises a field of hooks according to the invention, as shown for example in FIG. 2. In the same way, the edge 400 of the lid comprises a field of hooks according to the invention, which by means of snapping in the hooks of the tongue 300 facilitate the fastening of the box.

The object, particularly moulded, for example the box, can be made of a plastic material or thermoplastic material, rigid or supple. In particular it can be a tape, from one face of which hooks project which are formed by moulding in a cavity roller as described in the European patent application 1042971 in the name of the applicant. In this case the supple tape with hooks is brought onto the object or objects which one wishes to provide with a hook-in-hook fastening as according to the invention.

The fastening can also be constituted by two supple tapes, whereby hooks project from one face of each of them which have been formed by moulding in a cavity roller or by extrusion according to the process described in the American patent U.S. Pat. No. 4,056,593.

Several embodiments have been described in this application, each having a certain number of features. It goes without saying that the embodiments constituted by a combination of a section or all the features of two or more than two of the embodiments described must also be considered as being part of this description.

What is claimed is:

1. An assembly comprising a first object having at least one surface from which at least one field of hooks projects, said hooks being arranged in rows and columns, each hook including a stem section and a single head section projecting laterally from the stem section, wherein at least one row includes at least one hook having a head projecting in a first direction and n successive hooks, following said at least one hook in said at least one row, each of said n hooks having a head projecting in a second direction opposed to said first direction, n being an integer that is equal to or greater than two, and wherein at least one column includes a succession of hooks having heads projecting in a common direction, and at least a second column includes a succession of hooks having heads that project alternately in said first direction and said second direction; and a second object having at least one surface from which at least one field of hooks projects, said hooks being arranged in rows and columns, each hook including a stem section and a head section projecting laterally from the stem section, wherein at least one row includes at least one hook having a head projecting in a first direction and n successive hooks, following said at least one hook in said at least one row, each of said n hooks having a head projecting in a second direction opposed to said first direction, n being an integer that is equal to or greater than two, and wherein at least one column includes a succession of hooks having heads projecting in a common direction, and at least a second column includes a succession of hooks having heads that project alternately in said first direction and said second direction, said hooks of said field of hooks of said first object engaging said hooks of said field of hooks of said second object to fix the first and second objects together.

2. The assembly according to claim 1, wherein said at least one row of both said first object and said second object includes a succession of m' hooks each having a head projecting in a first direction and n' hooks each having ahead projecting in a second direction, wherein m' and n' are integers and m' is less than n'.

3. The assembly according to claim 1, wherein said hooks of said at least one column of both said first object and said second object project in a first direction and wherein a first even number of succeeding columns in both objects include hooks in each row that are arranged in pairs, said hooks of each said pair being oriented back to back in odd rows, and face to face in even rows, a following column including hooks that all project in said second direction, and wherein a second even number of succeeding columns in both objects include hooks in each row that are arranged in pairs, said hooks of each said pair of said second even number of columns being oriented like said hooks of said first even number of columns, said second even number of columns succeeded by a column having hooks that are all oriented in said first direction.

4. The assembly according to claim 3, wherein said first direction and said second direction are opposing directions.

5. The assembly according to claim 3, wherein said first even number is equal to said second even number.

6. The assembly according to claim 1, wherein said hooks in said at least one row of both said first object and said second object are arranged according to a repetition cycle constituted by at least one single head hook projecting in said first direction and n hooks projecting in said second direction.

7. The assembly according to claim 6, wherein said at least one hook projecting in said first direction includes m hooks projecting in said first direction, m being an integer greater than or equal to 1, and wherein said rows in said field of hooks are offset with respect to each other by a number of hooks between 1 and m-n-1.

8. The assembly according to claim 6, wherein a distance between said hook stems proximate said at least one surface between an nth hook of said n hooks and said at least one hook is smaller than any of the distances between two other hooks of the row.

9. The assembly of claim 8, wherein said distance between said nth hook of said n hooks and said m hook is approximately zero.

10. The assembly according to claim 6, wherein a distance between said at least one hook and a first of a succession of said n hooks is greater than any of the distances between two other hooks of the row.

11. The assembly according to claim 1, wherein said rows of both said first object and said second object are offset with respect to each other.

12. The assembly according to claim 1, wherein a distance between two adjacent rows of both said first object and said second object is less than a transverse thickness of the hooks measured in the direction of the columns and perpendicularly to the rows.

13. The assembly of claim 12, wherein said distance between two adjacent rows is less than half said transverse thickness of said hooks.

14. The assembly according to claim 1, wherein said stem of said hooks widens as it approaches said at least one surface and a lateral surface on a side of said hook opposing said head is inclined.

15. The assembly according to claim 1, wherein both said first object and said second object include a supple tape, from one face of which said hooks project.

16. The assembly according to claim 1, wherein of both said first object and said second object are moulded and made of a rigid material.

17. The assembly of claim 1, wherein said at least one hook of both said first object and said second object includes a succession of m hooks, m being an integer that is less than n.

* * * * *